US006634958B1

(12) United States Patent
Kusumoto

(10) Patent No.: US 6,634,958 B1
(45) Date of Patent: Oct. 21, 2003

(54) GOLF CLUB

(75) Inventor: Harunobu Kusumoto, Tokorozawa (JP)

(73) Assignee: Daiwa Seiko, Inc., Tokyo (JP)

( * ) Notice: Subject to any disclaimer, the term of this patent is extended or adjusted under 35 U.S.C. 154(b) by 0 days.

(21) Appl. No.: 09/234,839

(22) Filed: Jan. 22, 1999

(30) Foreign Application Priority Data

Jan. 22, 1998 (JP) ..... 10-010438

(51) Int. Cl.[7] ..... A63B 53/02

(52) U.S. Cl. ..... 473/310; 473/311; 473/312; 473/316; 473/345

(58) Field of Search ..... 473/305–315, 473/316–323, 324, 327, 340, 341, 343, 349, 350

(56) References Cited

U.S. PATENT DOCUMENTS 1,336,671 A * 4/1920 Backus
1,906,239 A * 5/1933 Reach
2,121,387 A * 6/1938 Houser
5,184,819 A * 2/1993 Desbiolles
5,257,807 A * 11/1993 Baumann
5,335,909 A * 8/1994 Green
5,377,979 A * 1/1995 Long
5,452,890 A * 9/1995 Bingman
5,470,068 A * 11/1995 Schmidt et al. ..... 473/311
5,632,695 A * 5/1997 Hlinka et al.
5,692,970 A * 12/1997 Nelson ..... 473/318
5,725,441 A * 3/1998 Jensen
6,077,172 A * 6/2000 Butler

FOREIGN PATENT DOCUMENTS

JP 07-185048 7/1995

* cited by examiner

*Primary Examiner*—Stephen Blau
(74) *Attorney, Agent, or Firm*—Liniak, Berenato & White

(57) ABSTRACT

A golf club includes a shaft and a head fixed to a forward end of the shaft. The said head has a recess formed in an upper surface of the head. The recess is not made to adhere to an outer circumferential surface of the shaft.

12 Claims, 7 Drawing Sheets

GOLF CLUB

BACKGROUND OF THE INVENTION

1. Field of the Invention

The present invention relates to a golf club.

2. Description of the Related Art

In the related iron type and wood type golf club, a head is attached to a forward end of a shaft by means of adhesion. In this case, the shaft and the head are connected with each other by means of adhesion even in a neck portion protruding from a crown section of a head body.

In this connection, when a golfer swings the golf club to hit a ball, the shaft is bent. At present, the shaft is mainly made of steel or FRP in which synthetic resin is reinforced by fiber. Therefore, it is possible to obtain a desirable bend of the shaft according to a required characteristic of the golf club. Accordingly, various arrangements are adopted with respect to material of the shaft and a quantity of impregnation of resin of the shaft. It is desirable that the aforementioned bend of the shaft is fully utilized all over the length of the shaft. When a region at the forward end of the shaft, in which the shaft is attached to the head, is long, it is impossible to fully utilize the bend of the shaft.

In the related golf club, an outer circumferential surface of the shaft is made to adhere to the neck portion protruding from an outer shell of the head. Therefore, it is impossible to fully utilize the bend that can be originally provided by the shaft.

SUMMARY OF THE INVENTION

The present invention has been accomplished when the inventors take notice of the fact that the original bend of the shaft is not fully utilized in the related structure of attaching the golf club head to the shaft. It is an object of the present invention to provide a golf club in which the bend of the shaft can be fully utilized.

In order to solve the above problems, the present invention provides a golf club including a shaft and a head fixed to a forward end of the shaft. The said head has a recess formed in an upper surface of the head. The recess is not made to adhere to an outer circumferential surface of the shaft.

Also, the present invention provides a golf club including: a shaft; and a head having a neck section into which the shaft is inserted, wherein a forward end of the shaft, the length of which is 15 to 40 mm, is made to adhere to the head, and a portion of the shaft on the base end side with respect to the adhesion region is not made to adhere to the head.

As described above, when the recess, in which the head is not made to adhere to the shaft, is formed in the crown section of the head and also when a portion of the neck of the head is not made to adhere to the shaft, it is possible to utilize a bend all over the shaft.

DETAILED DESCRIPTION OF THE PREFERRED EMBODIMENTS

Embodiments of the present invention will be specifically explained below referring to the accompanying drawings.

First Embodiment

Figure 1A:
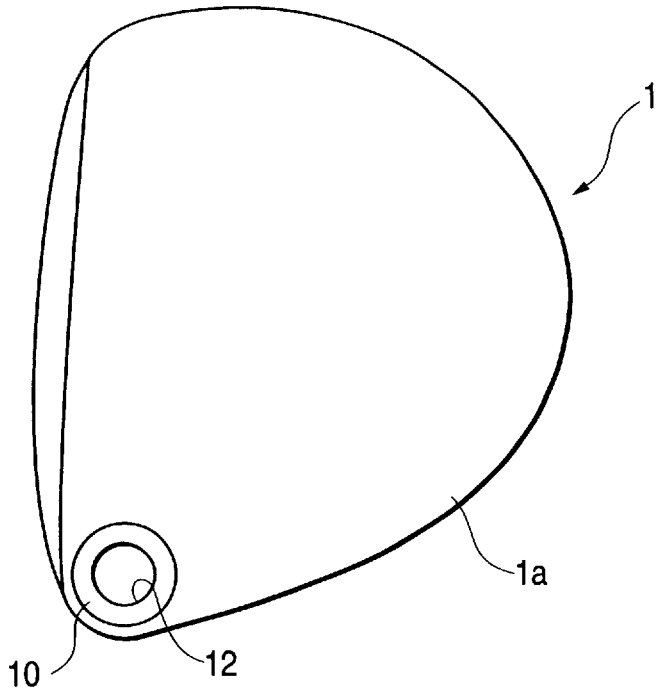
FIG. 1A is a plan view of a head showing a first embodiment of the present invention.
Figure 1B:
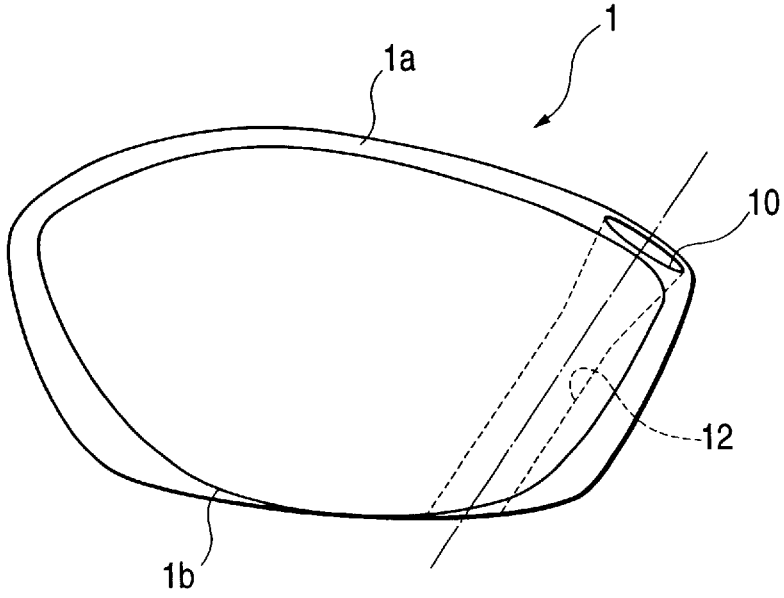
FIG. 1B is a front view of the head of FIG. 1A.
Figure 2A:
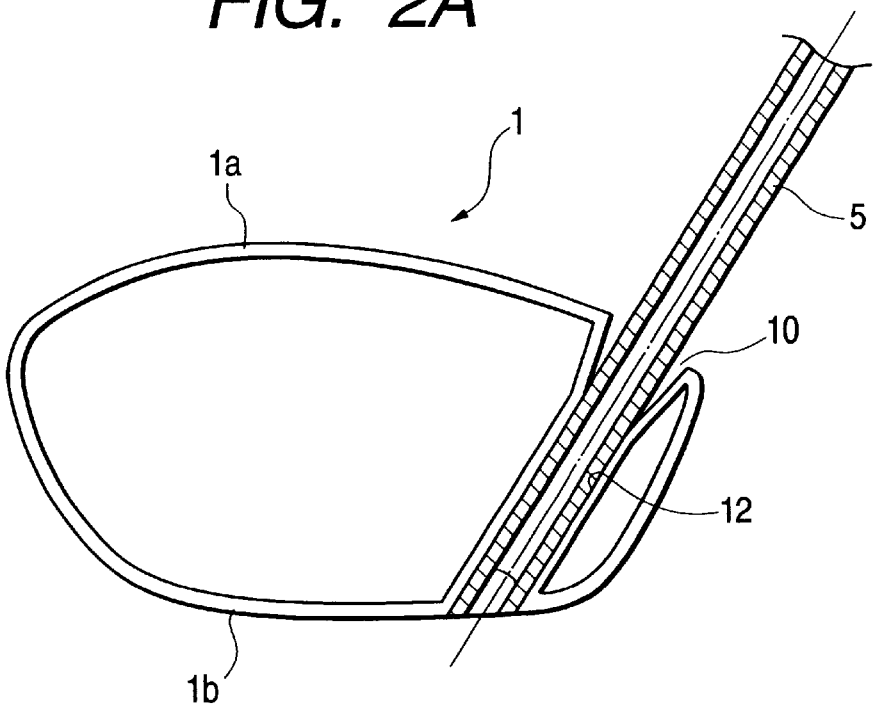
FIG. 2A is a view showing a state in which the shaft is attached to the head of the structure shown in FIGS. 1A and 1B.

FIGS. 1 and 2 are views showing a first embodiment of the present invention. In this embodiment, there is shown an example in which the present invention is applied to a wood type golf club with a hollow shape. In the crown section 1*a* of the outer shell composing a head 1, there is formed a recess 10 into which the shaft 5 is inserted. In this recess 10, the shaft 5 is not made to adhere to the recess 10. The shaft 5 is made to adhere to the adhesion hole 12, the diameter of which is substantially the same as that of the shaft, formed in a portion lower than the recess 10. Accordingly, as shown in FIG. 2A, adhesion is not conducted in the region of the recess 10. Therefore, it is possible for the shaft to bend in this region.

Figure 2B:
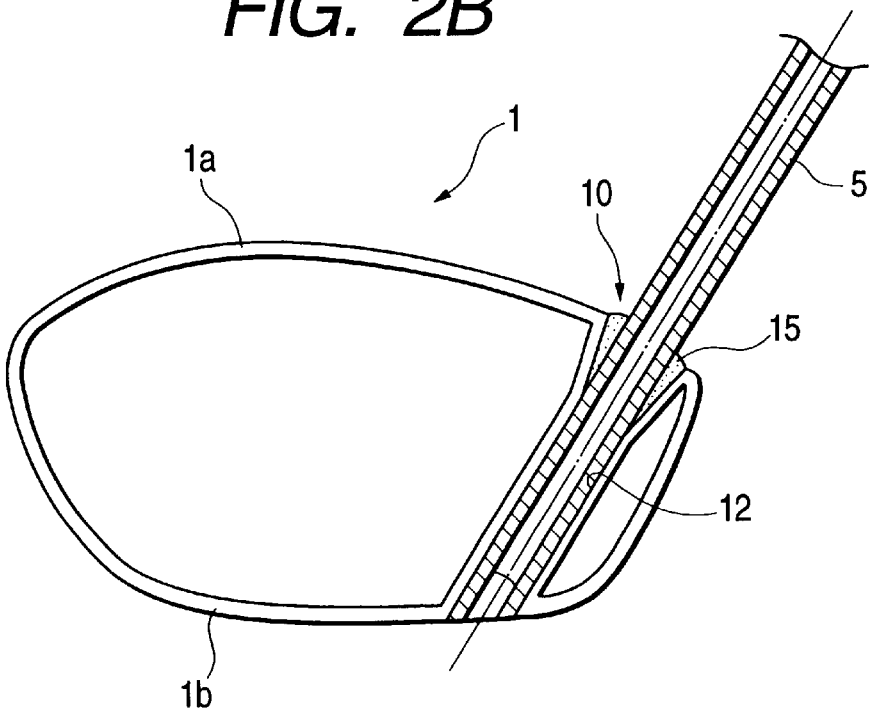
FIG. 2B is a view showing a modification of FIG. 2A.

Concerning the length of the adhesion hole 12, although it depends upon the type of a golf club, material, weight of the head and adhesive to be used, when the length of the adhesion hole 12 is 15 to 40 mm, it is possible to provide a sufficiently high adhesive strength. Due to the foregoing, the depth of the recess 10 formed in the outer shell of the head 1 can be determined to be in a range from 5 to 25 mm. It is preferable that the depth of the recess 10 is determined to be in a range from 10 to 25 mm. As shown in FIGS. 2A and 2B, when the shape of the recess 10 is formed into a bowl-shape, the diameter of which is gradually reduced downward, it is possible for the shaft to be bent in all directions in this region.

When the recess 10 is formed in the crown section 1*a* of the head 1 as described above, it is visible to the eye from the outside. Therefore, in order to improve an appearance of the golf club, it is preferable that the filler 15 is charged into the recess 10 as shown in FIG. 2B. In this case, the filler 15 is preferably made of rubber or foaming material, the elastic modulus of which is 1 to 100 kgf/mm$^2$, so that the shaft 5 can be bent in the region of the recess 10.

In the embodiment, materials of the head and shaft are not limited to the above specific example, but various material may be used. It is possible to apply the above structure to a solid wood head, ordinary iron head and hollow iron head. In the above embodiment, the adhesion hole 12 extends to the sole 1*b* of the head 1. However, it is possible to adopt a structure in which the adhesion hole 12 ends at an intermediate portion in the head 1.

In the above embodiment, the recess 10 is formed into a round bowl-shape, the diameter of which is gradually reduced downward. However, it is possible to form the recess 10 into a shape so that the shaft can be bent with directivity according to a required characteristic of the golf club. For example, as shown by reference numerals 10*a* to 10*f* in FIGS. 3A to 3F, the recess 10 can be variously deformed so that the shaft can be bent in various directions.

Figure 3A:
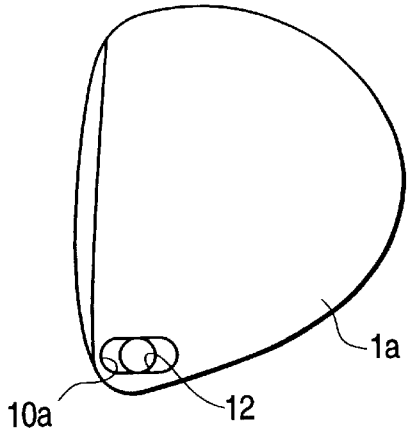
FIGS. 3A to 3F are views respectively showing variations of a recess formed in a crown section of the head.

FIG. 3A is a view showing an of structure in which the recess 10*a* is extended in the face-back direction. According to the above structure, the shaft can be easily bent in the face-back direction. Therefore, it is possible to obtain a golf club by which a ball tends to be raised while toe-down is suppressed, that is, it is possible to obtain a golf club by which an impact loft tends to be increased.

Figure 3B:
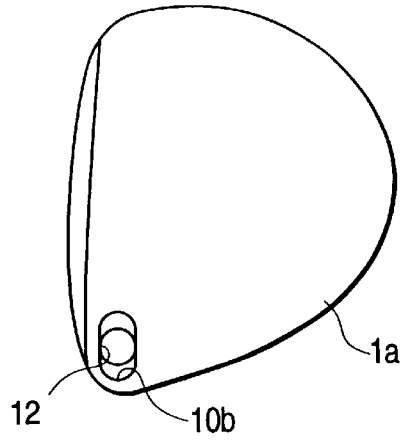

FIG. 3B is a view showing an example of structure in which the recess 10*b* is extended in the toe-heel direction. According to the above structure, the shaft tends to be bent in the toe-heel direction. Therefore, it is possible to provide a golf club by which switch can be easily conducted at the top of swing while a ball is suppressed from rising, that is, it is possible to provide a golf club by which switch can be conducted by a light load at the top of swing.

Figure 3C:
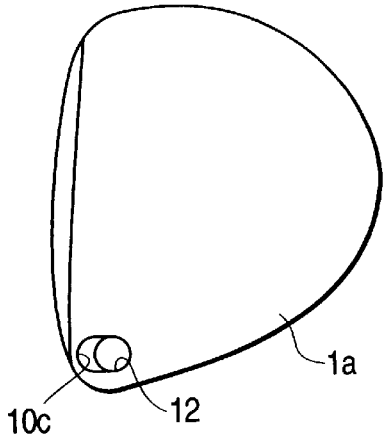

FIG. 3C is a view showing an example of structure in which the recess 10*c* is extended in the face direction and at the same time a bend is restricted on the back side of the shaft. According to the above structure, the shaft tends to be bent in the face direction. Therefore, it is possible to provide a golf club by which a ball tends to be raised while toe-down is suppressed, that is, it is possible to provide a golf club in which the impact loft tends to be increased.

Figure 3D:
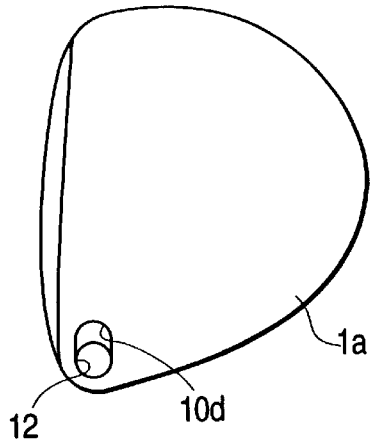

FIG. 3D is a view showing an example of structure in which the recess 10*d* is extended in the toe direction and a bend of the shaft is restricted on the heel side. According to the above structure, it is possible to provide a golf club, the shaft of which tends to be bent in the toe direction and switch can be easily conducted at the top of swing while toe-down is suppressed, that is, it is possible to provide a golf club by which switch can be conducted by a light load.

Figure 3E:
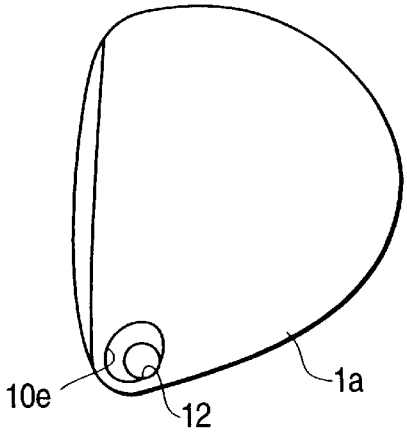

FIG. 3E is a view showing an example of structure in which the recess 10*e* is formed into a substantial sector, so that a bend of the shaft can be restricted on the heel side and the back side. According to the above structure, the shaft tends to be bent in the face and the toe direction. Therefore, it is possible to provide a golf club by which switch can be easily conducted at the top of swing and a ball tends to be raised while toe-down is suppressed.

Figure 3F:
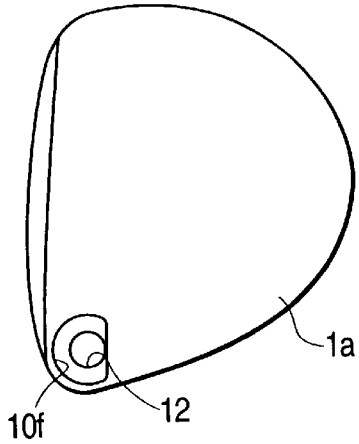

FIG. 3F is a view showing an example of structure in which the recess 10*f* is substantially semicircular and a bend of the shaft is restricted on the back side. According to the above structure, the shaft tends to be bent in the directions of the face, toe and heel. Therefore, it is possible to provide a golf club by which switch can be easily conducted at the top of swing and a ball tends to be raised.

Figure 4:
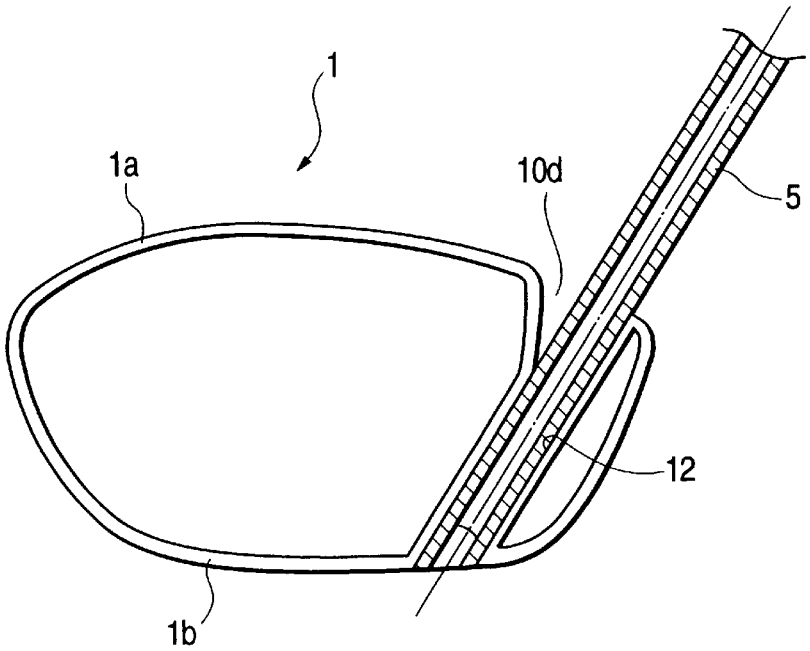
FIG. 4 is a view showing a structure of the variation shown in FIG. 3D.

In this connection, in the above structure, concerning the direction to restrict a bend, as shown in FIG. 4 in which the structure of FIG. 3D is illustrated, adhesion may be conducted to the surface of the crown section 1*a* of the head. However, it is preferable that adhesion is conducted to a region of about 20 mm from the sole side and adhesion is not conducted in the remaining upper region in the vicinity of the recess 10*d*.

Second Embodiment

Figure 5A:
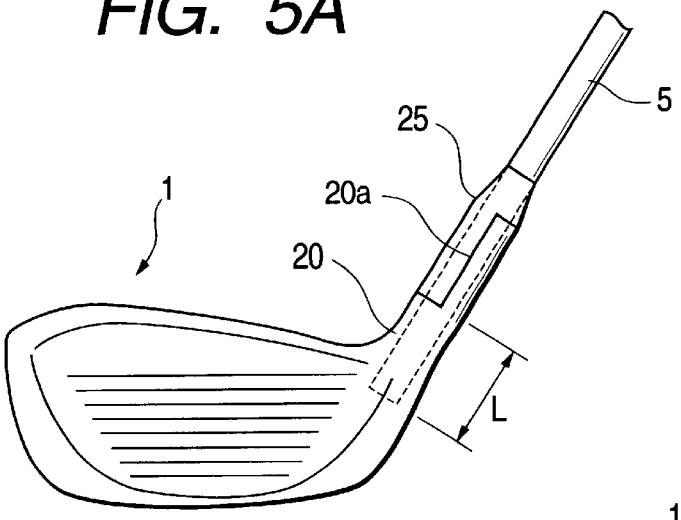
FIG. 5A is a view of a wood type golf club showing a second embodiment of the present invention.
Figure 5B:
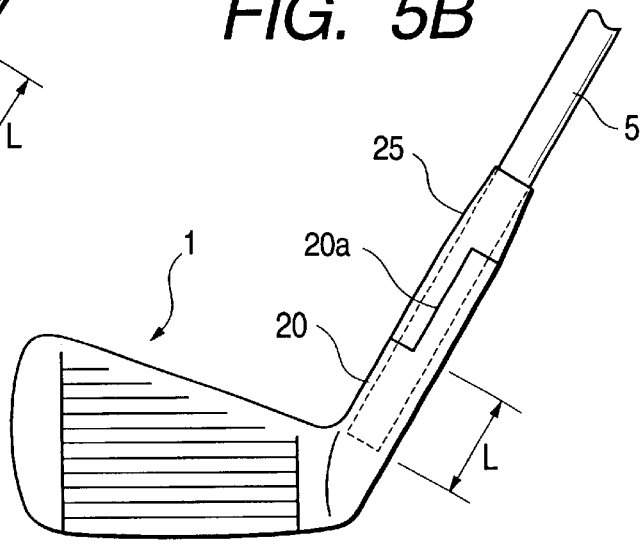
FIG. 5B is a view showing an iron type golf club showing the second embodiment of the present invention.

FIGS. 5A and 5B are a view showing a second embodiment of the present invention. In the first embodiment, there is formed a recess, which is not made to adhere to the shaft, in the crown section of the head. However, in the case of a golf club as shown in FIGS. 5A and 5B, in the head 1 of which a neck section 20, into which the shaft 5 is inserted and fixed, is integrally formed, the following structure may be adopted.

A forward end portion, the length of which is L (15 to 40 mm), of the shaft 5 is made to adhere and fixed to the head 1 in which the neck section 20 is formed. In this case, as shown in FIG. 5A, region L in which adhesion is conducted is the neck section 20 and an attaching hole (not shown) formed in the head 1. Alternatively, as shown in FIG. 5B, region L in which adhesion is conducted is the neck section 20. On the upper side of region L, there is provided an elastically deformable socket 25 in a direction in which the shaft is required to be bent. In the structure shown in FIGS. 5A and 5B, the shaft 5 tends to be bent onto the toe side. In the neck section 20 of the upper side of region L, there is formed a cutout section 20*a* in which the toe side is cut out by a semicircular shape. A bend of the shaft 5 on the heel side is restricted by the neck section 20 which extends in a semicircular shape on the upper side of region L. The direction in which the shaft tends to be bent can be variously changed in accordance with the position at which the cutout section is formed. When all portions located on the upper side of region L are covered with the socket 25, it is possible to compose a structure in which the shaft tends to be bent in all directions as shown in FIG. 1. In this connection, the socket 25 may be provided as shown in the drawing, or the socket 25 may not be provided.

It is preferable that the above head of the present invention is combined with a shaft, the rigidity of the forward end of which is not so high. Specifically, it is preferable that the head of the present invention is attached to a shaft, the flexural rigidity of the forward end portion of which is $EI<5.0\times10^6$ kgf·mm$^2$. It is more preferable that the head of the present invention is attached to a shaft, the flexural rigidity of the forward end portion of which is $EI<3.5\times10^6$ kgf·mm$^2$.

According to the first and second embodiments, an adhesion area at the forward end of the shaft, in which the shaft is made to adhere to the head, is reduced. Therefore, a region of the shaft, in which the shaft is bent, can be extended. Accordingly, it is possible to provide a golf club, the original bending characteristic of which can be sufficiently exhibited.

Third Embodiment

Next, referring to FIG. 6A, a golf club of a third embodiment of the present invention will be explained below.

Figure 6A:
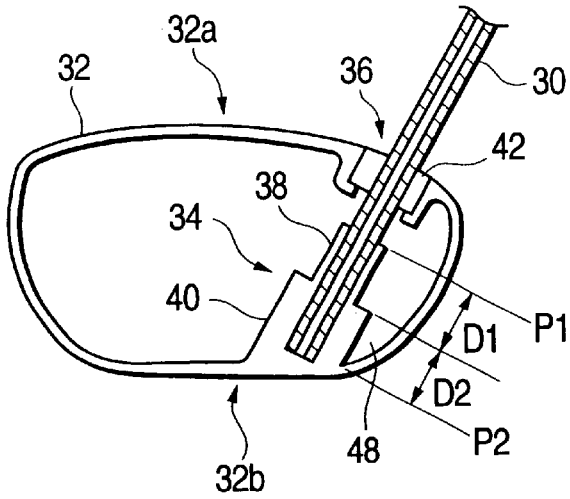
FIG. 6A is a view showing an inner structure of the head of a third embodiment of the present invention.

As shown in FIG. 6A, the golf club of this embodiment includes: a shaft 30; a grip (not shown) provided at a base end of the shaft 30; and a head 32 provided at a forward end of the shaft 30. This golf club is composed to accomplish the following object. The shaft 30 can be positively joined to the head 32 at a joining section (neck, hosel) 34 of the shaft 30 and the head 32, and also it is possible to increase a quantity of bend of the shaft 30 to a desired value without causing stress concentration in a region of the shaft close to the joining section 34, and further it is possible to reduce the weight and rigidity of the joining section 34.

In order to accomplish the above object, the shaft 30 is arranged and housed in the head 32 in the joining section 34. In the crown section 32*a* of the head 32, there is provided an opening 36 into which the shaft 30 can be inserted so as to be joined in the joining section 34, and a quantity of bend of the shaft 30 can be increased to a desired value due to the opening 36.

The joining section 34 includes: a bending region capable of bending in accordance with a state of bending and twisting of the shaft 30 in the case where a golfer swings the club; and a fixing region in which the shaft 30 is firmly joined and fixed to the head 32. That is, the head 32 has a bending portion 38 covering the shaft in the bending region and a fixing portion 40 covering the shaft 30 in the fixing region. The bending portion 38 and the fixing region 40 are integrated with each other. Specifically, the fixing portion 40 is fixed to the sole section 32*b* of the head 32, and the bending portion 38 is arranged integrally and continuously above the fixing portion 40.

The wall thickness of the bending portion 38 is relatively small and the rigidity of the bending region 38 is relatively low so that the bending region 38 can be bent in accordance with the state of bending and twisting of the shaft 30 when a golfer swings the club. The wall thickness of the fixing portion 40 is relatively large and the rigidity of the fixing portion 40 is relatively high so that the fixing portion 40 can firmly join and fix the shaft 30 to the head 32. The wall thickness of the bending portion is set to be 0.3 mm–1.0 mm, preferably 0.3–0.9 mm. Incidentally, the wall thickness of the bending portion 38 may be formed into a taper shape.

In addition, in order to decrease the stiffness in the bending region, the flexural rigidity of the bending portion 38 may be set to be 10.000–40.000 kgf·mm$^2$, preferably 10.000–35.000 kgf·mm$^2$.

In FIG. 6A, there is shown a joining section 34 composed of a bending portion 38, the wall thickness of which is made to be small, and a fixing portion 40, the wall thickness of which is made to be larger than that of the bending portion 38.

According to the above structure, it is possible to realize a golf club capable of extending a quantity of bend of the shaft 30 without causing stress concentration in a region of the shaft 30 close to the joining section 34. In this case, a quantity of bend of the shaft 30 can be extended.

When a soft member 42 is put into the opening 36 of the head 32, it is possible to adjust a quantity of bend of the shaft 30 in accordance with the object of using the club and the preference of a golf player. In this case, it is preferable that the soft member 42 is made of material, which is sufficiently softer than the shaft 30 and the head 32, such as rubber, foaming material, plastic or wood.

In this connection, the structure of the third embodiment described above is only an example of the present invention. It is possible to variously change the structure as follows.

Figure 6B:
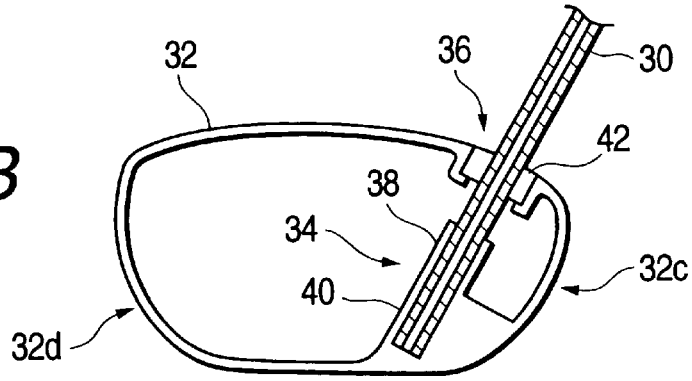
FIG. 6B is a view showing the inner structure of the head of a first modification the third embodiment of the present invention.

As a first modification, for example, as shown in FIG. 6B, the fixing portion 40 of the joining section 34 and the heel section 32*c* of the head 32 may be integrated into one body. That is, the fixing portion 40 is formed so as to embed a space 48 shown in FIG. 6A.

According to the above first modification, since the entire fixing portion 40 is firmly supported by the heel section 32*c* of the head 32. Therefore, for example, even when the shaft 30 is given a heavy load when a golfer swings the club, there is no possibility that the fixing portion 40 is deformed. Accordingly, even when the wall thickness of the fixing portion 40, which is opposed to the toe 32*d*, is made to be small in the same manner as that of the bending portion 38, the shaft 30 can be strongly joined and fixed to the head 32.

Figure 6C:
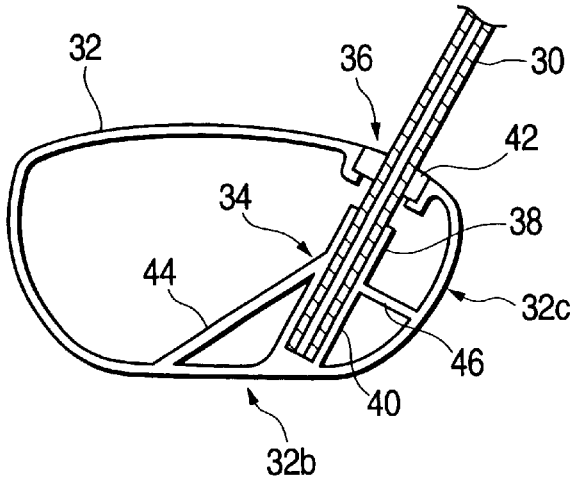
FIG. 6C is a view showing the inner structure of the head of a second variation of the third embodiment of the present invention.

As a second modification, for example, as shown in FIG. 6C, the fixing portion 40 of the joining section 34 may be supported by the sole section 32*b* and the heel section 32*c* of the head 32 via two support members 44, 46. The specific structure is described as follows. Concerning one 44 of the support members, one end of the support member 44 is fixed to an end of the fixing portion 40, and the other end is fixed to the sole section 32*b* of the head 32. Concerning the other 46 of the support members, one end of the support member 46 is fixed to an end of the fixing portion 40, and the other end is fixed to the heel section 32*c* of the head 32.

According to the above second modification, one end of the fixing portion 40 is supported by the sole section 32*b* and the heel section 32*c* of the head 32 respectively via the two support members 44, 46, and the other end (forward end P2 of the joining section 34) is supported by the sole section 32*b* of the head 32. As a result, the fixing portion 40 of the joining section 34 is supported by three portions. Therefore, for example, even if the shaft 30 is given a heavy load when a golfer swings the club, there is no possibility that the fixing portion 40 is deformed. Accordingly, even if the wall thickness of the fixing portion 40 is made to be small in the same manner as that of the bending portion 38, it is possible to join and fix the shaft 30 to the head 32 strongly. Further, outer diameters of the two support members 44, 46 can be made to be relatively small in the same manner as that of the first embodiment described before, for example, outer diameters of the two support members 44, 46 can be made to be 3.0 to 10.0 mm. Therefore, the weight of the entire head 32 can be reduced, that is, the weight of the entire golf club can be reduced.

According to the third embodiment, the shaft can be positively joined to the head at the joining section of the shaft and the head. It is possible to avoid the occurrence of stress concentration in a region of the shaft close to the joining section. Further, the weight of the joining section can be reduced and the rigidity of the joining section can be also reduced.

Fourth Embodiment

Next, referring to FIG. 7, a golf club of a fourth embodiment of the present invention will be explained below.

Figure 7:
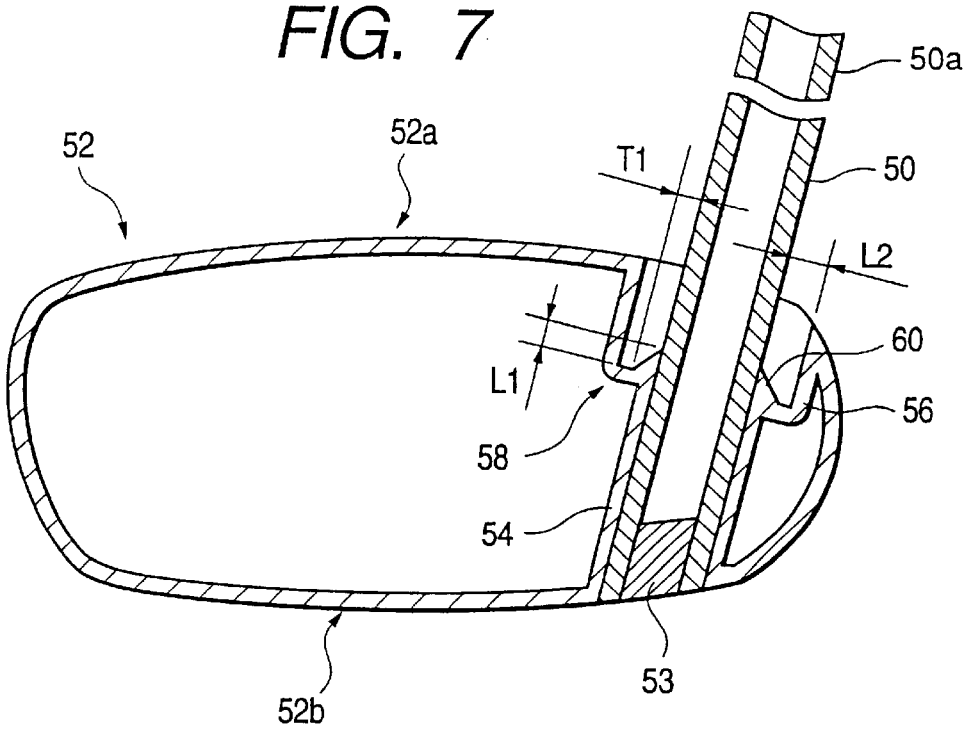
FIG. 7 is a sectional view showing an inner structure of the head of a fourth embodiment of the present invention.

The golf club of the fourth embodiment shown in FIG. 7 includes: a shaft 50; a grip (not shown) provided at a base end 50*a* of the shaft 50; a head 52 provided at a forward end of the shaft 50; and a cap 53 embedded onto a hollow portion of the forward end of the shaft 50 so as to form a smooth sole section 52*b* of the head 50.

The head 52 includes a small diameter portion 54 (a fixing region) to join and fix the forward end of the shaft 50 to the head. Further, the head 52 includes a large diameter portion 56 (a non-fixing region) between the small diameter portion 54 and a crown section 52*a* of the head 52, so that the bend of the shaft can be obtained in the large diameter portion 56 at the time of the swing. There is provided a step portion 58 between the small diameter portion 54 and the large diameter portion 56. The shaft 50 is separated from the large diameter portion 56 by a gap L2 in a region from the step portion 58 to the crown section 52*a*. The width of gap L2 is determined to be 0.3 mm or more.

According to the above structure, it is possible to realize a golf club capable of extending a quantity of bend of the shaft 30.

Further, there is provided a support portion 60 formed in a taper shape, which gets thinner from the step portion 58 toward the crown section 52*a*. The support portion 60 is integrally formed with the step portion 58. Accordingly, since an adhesive region of the shaft 50 is extended from a lower end of the small diameter portion 54 to an upper end of the support portion 60, not only the bend of the shaft 50 is fully obtained, but also the adhesive strength is improved.

A length L1 of the support portion 60, that is, the length from an upper surface of step portion 58 to the upper end of the support portion 60, is set to be 3 mm or more, and preferably, is set to be 5–15 mm. In case that the length L1 is too short, stress concentration is apt to be caused. In case that the length L1 is too long, it is difficult to obtain the bend of the shaft in the non-fixing region.

A maximum width T1 of the support portion 60 is set to be 0.5–5.0 mm. In case that the maximum width T1 is less than 0.5 mm, it is difficult to obtain an effect that releases the stress concentration in the taper region. Further, in case that the maximum width T1 is more than 5.0 mm, it is also difficult to obtain the effect releasing the stress concentration because of the rapid change of the stiffness in a direction of the length of the support portion 60.

With the support portion 60 thus structured, not only the bend of the shaft 50 is obtained in the non-fixing region of the head 52, but also stress concentration in accordance with the bend of the shaft 50 can be suppressed by the support portion 60.

In addition, in stead of the support portion 60, in order to release the stress concentration, a soft material, an adhesive material, or elastic member may be put into a space defined by the upper surface of the step portion 58, the shaft 50, and the large diameter portion 56.

In case that the head 52 is formed without the support portion 60, the width of the gap L2 can be set to be 0.3 mm. On the other hand, in case that the support portion 60 is provided in the head 52 as shown in FIG. 7, the width of the gap L2 can be largely set in accordance with the maximum width T1 of the support portion.

Incidentally, the support portion 60 may be separately formed with the step portion 58 that is, the head 52.

Fifth Embodiment

Next, referring to FIG. 8, a golf club of a fifth embodiment of the present invention will be explained below. Portions corresponding to these of the fourth embodiment are designated by the same reference numerals.

In the fifth embodiment, the head 52 includes a shaft holding portion 70 defining a shaft holding hole for fixing the forward end of the shaft 50. The inner diameter of the shaft holding portion 70 is substantially unifomly set from the sole section 52*b* to the crown section 52*a* of the head 52.

The shaft 50 has a small diameter portion 72 extending from the base end of the shaft 50 toward the forward end of the shaft 50, a large diameter portion 74 disposed between the sole section 52*b* of the head 52 and the small diameter portion 72, and a taper portion 76 disposed between the small diameter portion 72 and the large diameter portion 74.

The shaft 50 is fixed to the head 52 by joining the large diameter portion 74 and the shaft holding portion 70 by means of adhesive. Accordingly, the shaft 50 and the head 52 define a fixing region extending from the sole section 52*b* to an upper end (a lower portion of the taper portion 76) 80 of the large diameter portion 74, and a non-fixing region extending from the upper end 80 of the large diameter portion 74 to the crown section 52*a* of the head 52.

With the golf club thus structured, the shaft 50 can be bend in the non-fixing region and a quantity of bend of the shaft 50 can be increased. Further, since the forward end of the shaft 50 does not contact with the head 52 in the non-fixing region, the breakage of the head 52 is prevented.

Further, in order to release stress concentration of the shaft 50, the shape of the taper portion 76 is determined as follows. That is, the difference between an outer diameter D1 in the lower portion 80 of the taper portion 76 and an outer diameter D2 in an upper portion 78 of the taper portion 76 (that is, $\phi D1-\phi D2$) is set to be 1.0 mm or more. In addition, the length L3 between the lower portion 80 and upper portion 78 is set to be 3 mm or more, and preferably set to be 5–15 mm.

In case that $\phi D1-\phi D2$ is less than 1.0 mm, at the time of the swing of the shaft 50, the shaft 50 may contact with the crown section 52*a* of the head 52 or an upper end of a hosel (not shown), so that the breakage may be caused.

Further, if the length L3 of the taper portion 76 is too short, there is a possibility that stress concentration is caused. Further, if the length L3 is too long, the bend of the shaft 50 in the non-fixing region is not applied.

In addition, since the outer diameter D1 of the shaft 50 in the fixing region is larger than that of the related shaft, a length of the fixing region can be reduced.

Figure 8:
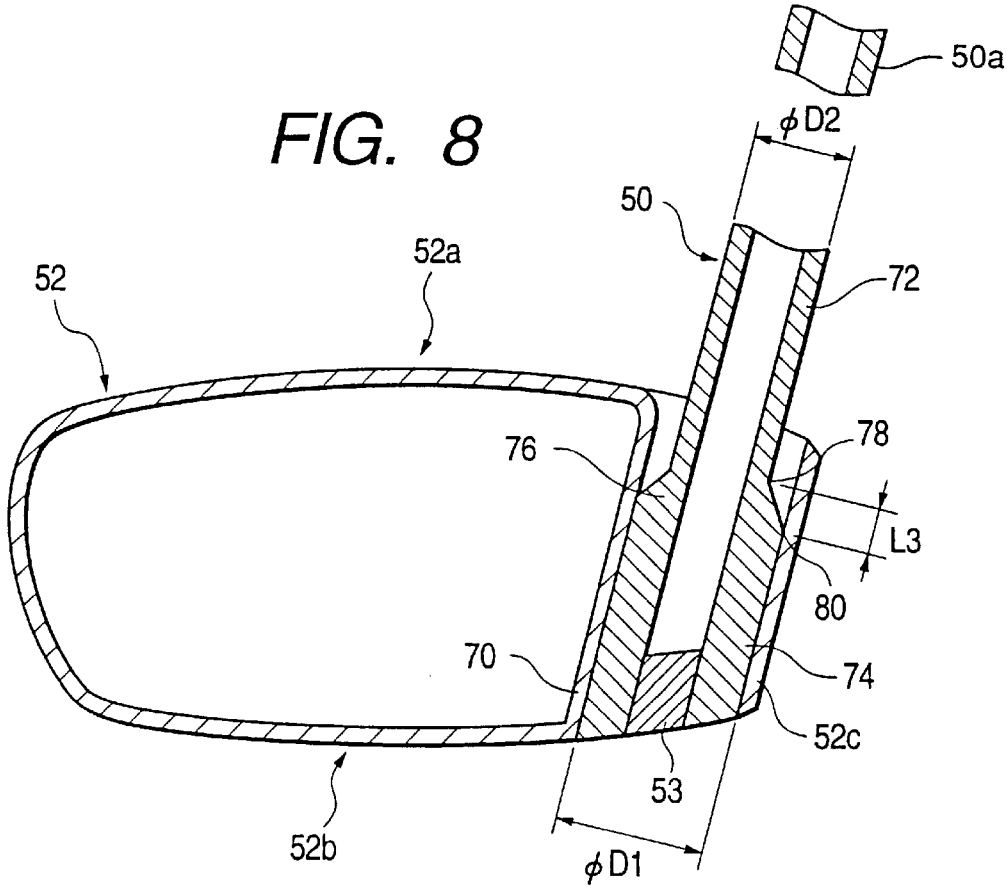
FIG. 8 is a sectional view showing an inner structure of the head of a fifth embodiment of the present invention.

In FIG. 8, a heel section 52*c* of the head 52 is formed by the shaft holding portion 70, so as to reduce material of the head 52. However, the heel section 52 of the head 52 may be separately formed with the shaft holding portion 70, as shown in FIG. 7, in accordance with the shape of the head 52.

Figure 9:
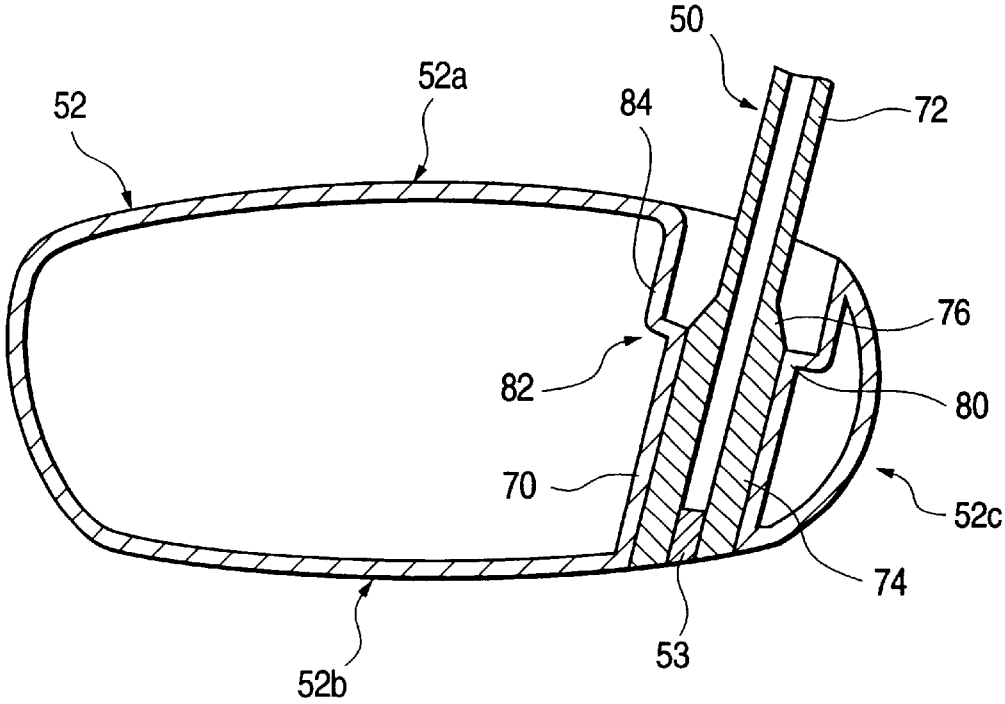
FIG. 9 is a sectional view showing the inner structure of the head of a first modification of the fifth embodiment of the present invention.

FIG. 9 shows a first modification of the fifth embodiment. In the shaft holding portion 70, there is provided a step portion 82 outwardly extending in the upper portion 80 of the large diameter portion 74 and a bulged portion 84 formed in the non-fixing region and connected to the step portion 82.

The head 52 thus structured can be applied to the shaft 50 that a quantity of bend is much large.

Figure 10:
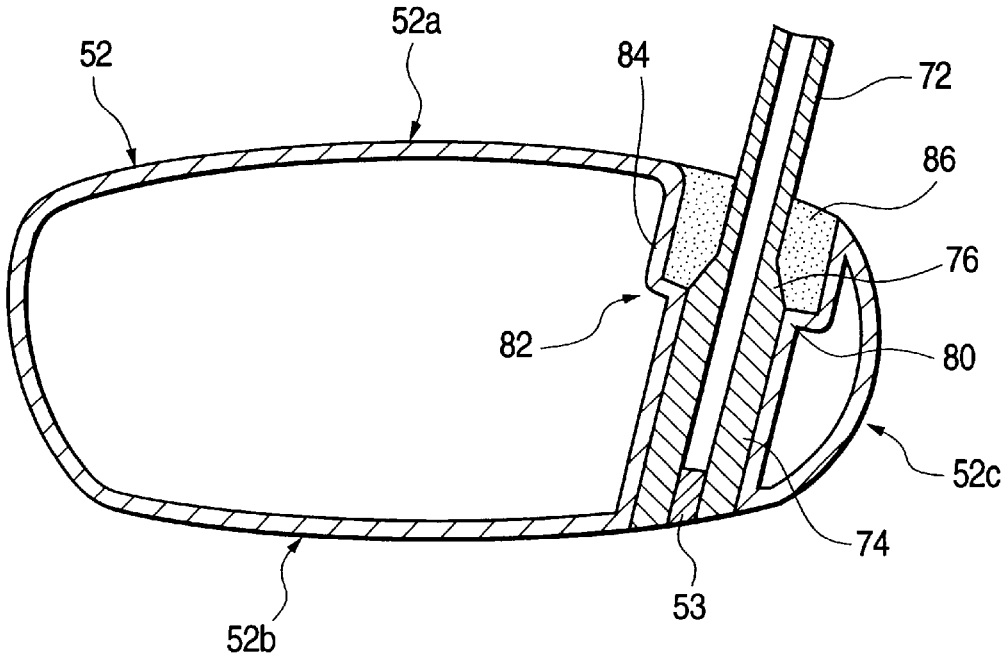
FIG. 10 is a sectional view showing the inner structure of the head of the first modification of the fifth embodiment of the present invention.

FIG. 10 shows a second modification of the fifth embodiment. The non-fixing region extending from the upper portion 80 of the large diameter portion 74 to the crown section 52*a* of the head 52 is filled with a flexible member 86, an elastic material, or the like. Accordingly, this structure can prevent foreign substance from entering a gap of the non-fixing region surround by the bulged portion 84 and the shaft 50.

Further, in FIGS. 8–10, the large diameter portion 74 of the shaft 50 is integrally formed with the small diameter portion 72. However, the large diameter portion 74 including the taper portion 76 may be separately formed with the small diameter portion 72. With this structure, the shaft 50 can be formed with a substantially straight diameter to the forward end of the shaft 50.

In FIGS. 6–9, the recess not made to adhere to an outer circumferential surface of the shaft is in open communication with an external environment from the shaft and head.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modification may be made thereto without departing from the spirit and scope of the invention.

What is claimed is:

1. A golf club head comprising:

a head formed with a shaft holding hole; and a shaft having a large diameter portion adjacent a terminal end thereof which is inserted into and fixed to a bottom portion of said shaft holding hole and a small diameter portion, the diameter of which is smaller than said large diameter portion, said small diameter portion being adjacent said large diameter portion and spaced apart from said terminal end and partially inserted into said shaft holding hole, said shaft having a continuous hollow cross section at a tip end and an inner surface of said tip end being continuous and extending in a substantially straight longitudinal direction, wherein said small diameter portion inserted into said head is separated from said shaft holding hole.

2. The golf club according to claim 1, wherein said shaft is formed with a taper portion between said large diameter portion and said small diameter portion.

3. The golf club according to claim 1, wherein said shaft holding hole is formed to have the substantially same inner diameter from an upper surface of said head to a lower surface of said head.

4. The golf club head according to claim 1, wherein said shaft holding hole has a diameter substantially the same from an upper surface of said hollow head to a lower surface thereof.

5. The golf club head according to claim 1, wherein said head is formed in a hollow shape, and said head includes a shaft holding portion defining said shaft holding hole, wherein said shaft holding portion is columnar and disposed within a hollow portion of said head.

6. The golf club head according to claim 1, wherein said shaft holding portion penetrates from an upper surface to a sole surface of said head.

7. The golf club head according to claim 1, wherein said head is formed without a hosel projecting upwardly from said head.

8. A golf club head comprising:

a head formed with a shaft holding hole;

a shaft having a large diameter portion which is inserted into and fixed to said shaft holding hole and a small diameter portion, the diameter of which is smaller than said large diameter portion, said small diameter portion being partially inserted into said shaft holding hole, wherein said large diameter portion is fixed directly to said shaft holding hole; and a flexible member provided between said small diameter portion and said shaft holding hole;

wherein said small diameter portion inserted into said head is separated from said shaft holding hole.

9. A golf club head comprising:

a head formed with a shaft holding hole; and a shaft having a large diameter portion adjacent a terminal end thereof which is inserted into and fixed to a bottom portion of said shaft holding hole and a small diameter portion, the diameter of which is smaller than said large diameter portion, said small diameter portion being adjacent said large diameter portion and spaced apart from said terminal end and partially inserted into said shaft holding hole, wherein said small diameter portion inserted into said head is separated from said shaft holding hole, and wherein said small diameter portion and said large diameter portion are formed as a unitary hollow shaft.

10. A golf club head comprising:

a head formed with a shaft holding hole; and a shaft having a large diameter portion adjacent a terminal end thereof which is inserted into and fixed to a bottom portion of said shaft holding hole and a small diameter portion, the diameter of which is smaller than said large diameter portion, said small diameter portion being adjacent said large diameter portion and spaced apart from said terminal end and partially inserted into said shaft holding hole, wherein said shaft is formed with a taper portion between said large diameter portion and said small diameter portion, wherein said small diameter portion inserted into said head is separated from said shaft holding hole, and wherein said small diameter portion, said taper portion, and said large diameter portion are integrally formed as a unitary hollow shaft.

11. A golf club comprising:

a shaft;

a head fixed to a forward end of said shaft, said head having a recess formed in an upper surface of the head, wherein said recess is not made to adhere to an outer circumferential surface of the shaft, said shaft has a large diameter portion adjacent a terminal end thereof which is inserted into and fixed to a bottom portion of said head, and a small diameter portion the diameter of which is smaller than said large diameter portion, said small diameter portion being adjacent said large diameter potion and spaced apart from said terminal end and partially inserted into said head, and said recess is not made to adhere to an outer circumferential surface of said small diameter portion, and said head includes a shaft holding portion defining a shaft holding hole into which said shaft is inserted, said shaft holding portion includes;

a fixing portion extending from a lower surface of said head, for joining the large diameter portion of said shaft; and a non-fixing portion extending from an upper surface of the head toward said fixing portion and having a diameter larger than said fixing portion and said small diameter portion of said shaft.

12. A golf club comprising:

a shaft, wherein said shaft is hollow; and a head fixed to said shaft by inserting a forward end of said shaft into a shaft holding hole, said head having a recess formed in an upper surface of the head, wherein said shaft holding hole is formed below said recess, wherein said shaft holding hole and said recess have a substantially equal diameter, wherein said recess is not made to adhere to an outer circumferential surface of the shaft, and said shaft holding hole penetrates to a sole surface of the head.

* * * * *